United States Patent [19]

Cole et al.

[11] Patent Number: 4,731,765

[45] Date of Patent: Mar. 15, 1988

[54] MEDI MINDER

[76] Inventors: George W. Cole, 4819 Ridge Rd., N. Little Rock, Ark. 72118; George Spector, 233 Broadway RM 3815, New York, N.Y. 10007

[21] Appl. No.: 900,327

[22] Filed: Aug. 25, 1986

[51] Int. Cl.[4] ..... G04B 47/00

[52] U.S. Cl. ..... 368/10; 206/534; 221/3

[58] Field of Search ..... 368/10, 109, 107; 206/534, 533; 221/2, 3

[56] References Cited

U.S. PATENT DOCUMENTS 3,762,601 10/1973 McLaughlin ..... 221/154

4,275,384 6/1981 Hicks et al. ..... 340/309.4

4,382,688 5/1983 Machamer ..... 368/10

4,526,474 7/1985 Simon ..... 368/10

4,660,991 4/1987 Simon ..... 368/10

FOREIGN PATENT DOCUMENTS 2269 6/1984 World Int. Prop. O. .

*Primary Examiner*—Bernard Roskoski

[57] ABSTRACT

A medication reminder device is provided and consists of a timer built into a housing to set time intervals in which medication within a compartment in the housing should be taken and release a latch mechanism so that a cover over the compartment can be opened for removal of the medication.

2 Claims, 3 Drawing Figures

MEDI MINDER

BACKGROUND OF THE INVENTION

The instant invention relates generall to timer mechanisms and more specifically it relates to a medication reminder device.

Numerous time mechanisms have been provided in prior art that are adapted to remind persons of correct intervals for taking pills and other medication. For example, U.S. Pat. Nos. 4,448,541; 4,483,626 and 4,526,474 all are illustrative of such prior art. While these units may be suitable for the particular purpose to which they address, they would not be as suitable for the purposes of the present invention as heretofore described.

SUMMARY OF THE INVENTION

A primary object of the present invention is to provide a medication reminder device that will overcome the shortcomings of the prior art devices.

Another object is to provide a medication reminder device that has a built in timer to set the time intervals in which the medicine within the device should be taken.

An additional object is to provide a medication reminder device that contains a plurality of contacts which are each activated by removal of a capsule/pill from the device to reset the timer for the next interval.

A further object is to provide a medication reminder device that is simple and easy to use.

A still further object is to provide a medication reminder device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
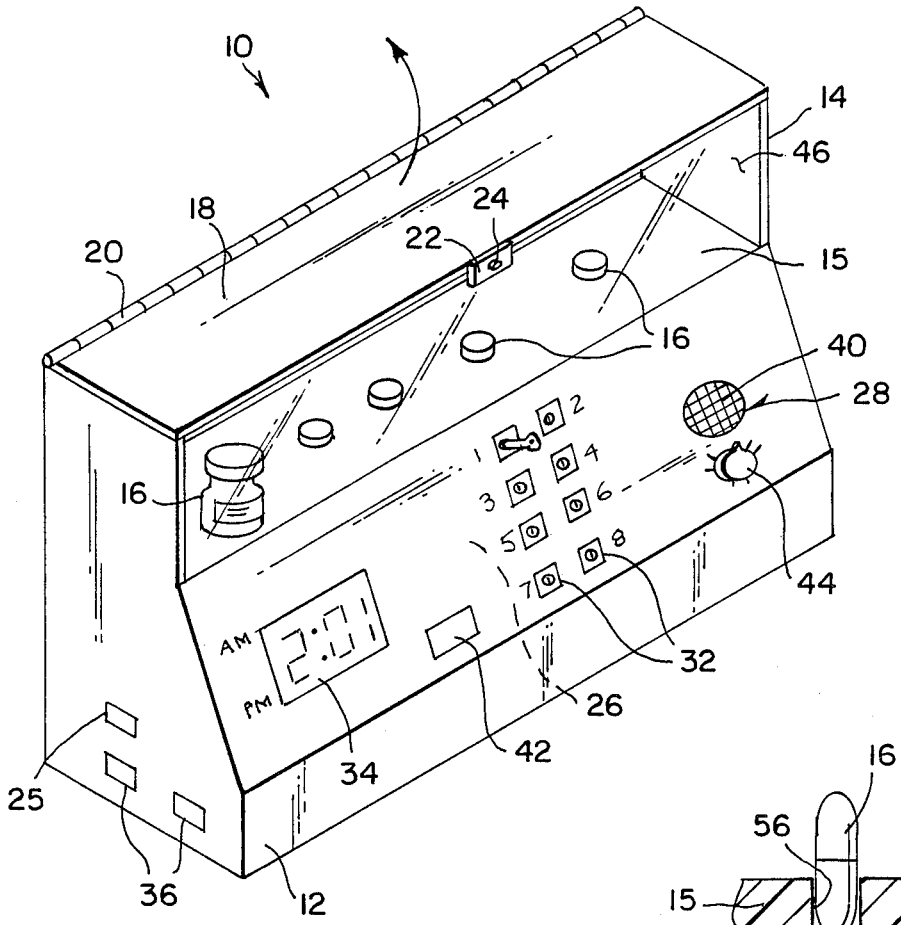
FIG. 1 is a perspective view of the invention.
Figure 3:
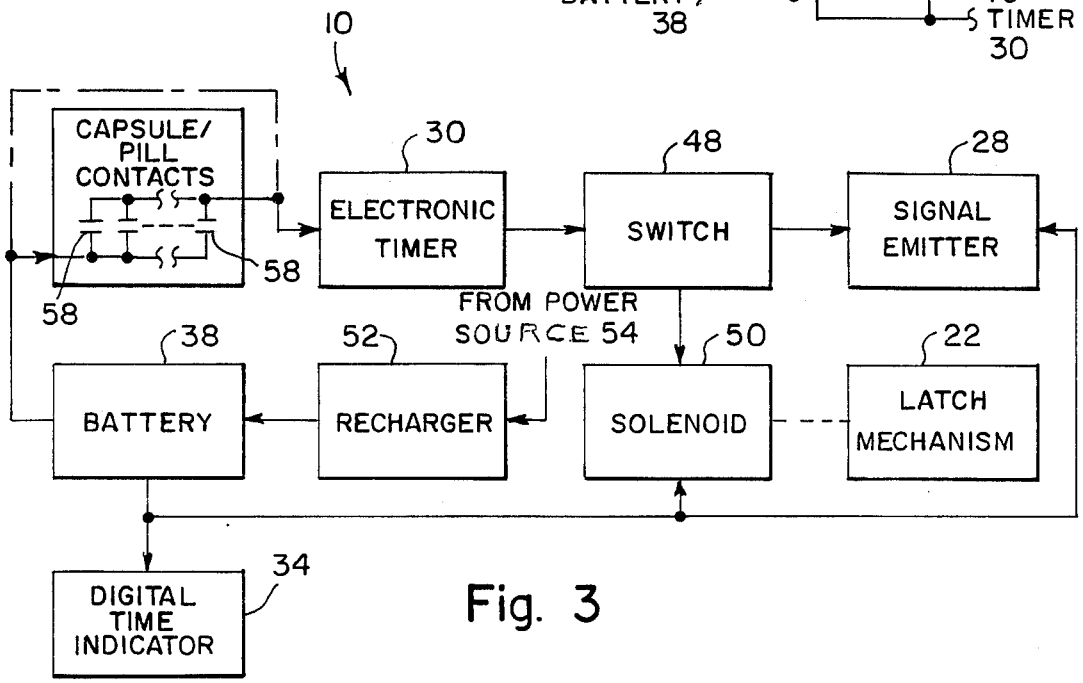
FIG. 3 is a diagrammatic block diagram of the electrical circuit using the modification in FIG. 2.

Turning now descriptively to the drawings, in which similar reference characters denote similar elements throughout the several views, FIGS. 1 and 3 illustrate a medication reminder device 10 consisting of a housing 12 that has a compartment 14 with a floor 15 for containing the medication 16. A cover 18 is hinged at 20 to top of the compartment 14. A latch mechanism 22 that has a bypass release button 24 is mounted on the compartment 14 to lock and unlock the cover 18. A lock set button 25 can be incorporated to reset the lock mechanism 22. A timer system 26 within the housing 12 is associated with the latch mechanism 22 to lock and unlock the cover 18 at adjustable time intervals so that the medication 16 can be removed when needed. The bypass button 24 can override the timer system 26 in an emergency when needed to release the lock mechanism 22. A signal emitter 28 is activated by the timer system 26 at the adjustable time intervals to notify a person (not shown) to remove the medication 16 from the compartment 14.

The timer system 26 consists of an electronic timer 30 that has a plurality of alarm set buttons 32 to set the adjustable time intervals. A digital time indicator 34 which has a pair of time set buttons 36 set the AM and PM time. A battery 38 supplies electricity to the electronic timer 30 and the digital time indicator 34. Buttons 32 may have key operated locks to lock set the desired timing.

The signal emitter 28 contains a chime loudspeaker 40 which has a silence button 42 that will turn off the loudspeaker until the next adjustable time interval. A volume control mechanism 44 regulates sound from the chime loudspeaker 40. The compartment 14 includes a transparent front window 46 so that the person can view the medication 16 within the compartment.

A switch 48 is electrically connected between the electronic tuner 30 and the signal emitter 28. A solenoid 50 is electrically connected between the switch 48 and the battery 58. The solenoid 50 will mechanically operate the latch mechanism 22. When the switch is activated, the chime loudspeaker 40 will sound and the latch mechanism 22 will unlock so that the medication 16 can be removed from the compartment 14. A recharger 52 is electrically connected between the battery 38 and a power source 54, such as house current for a safe guard during a power failure.

Figure 2:
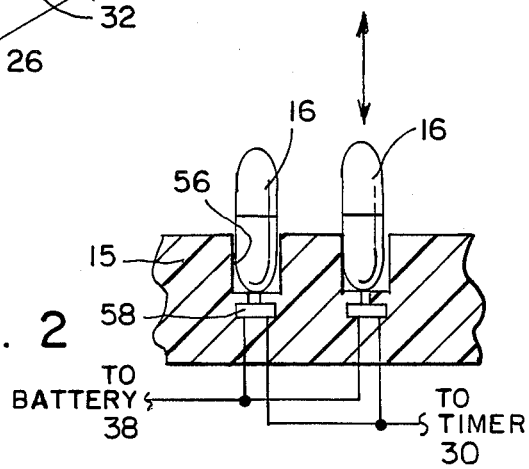
FIG. 2 is an enlarged cross sectional view of a modification showing the housing floor with a plurality of contacts that are activated when a capsule/pill is removed from a seat therefrom.

As shown in FIG. 2 the floor 15 within the compartment 14 of the housing 12 has a plurality of seats 56 and a plurality of contacts 58. Each of the contacts 58 are mounted within the floor 15 of the compartment 14 under each of the seats 56. The contacts 58 are electrically connected in series between the battery 38 and the electronic timer 30 (see FIG. 3), which are activated when the medication 16 being a capsule/pill is removed from any of the seats 56 to close one of the contracts 58 so that the timer 30 will operate till the next adjustable time interval.

The medication reminder device 10 can also include a plurality of repeat alarm position buttons (not shown) to override the alarm set buttons 32 and a separate cancel button (not shown) for each position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A medication reminder device comprising:

(a) a housing having a compartment containing a plurality of individual medication units;

(b) a cover hinged to top of said compartment;

(c) a latch mechanism mounted on said compartment to lock and unlock said cover;

(d) an electric circuit having a timer system within said housing controlling said latch mechanism, to lock and unlock said cover at adjustable time intervals so that said medication units can be removed when needed;

(e) a signal emitter in said circuit activated by said timer system at said adjustable time intervals to notify a person when to remove a medication unit from said compartment wherein said timer system comprises:

(f) an electronic time in said circuit, having a plurality of alarm set buttons to set said adjustable time intervals;

(g) a digital time indicator in said circuit having a pair of time set buttons to set AM or PM time;

(h) a battery to supply electricity to said circuit;

(i) timer actuating means in said circuit responsive to removal of medication units from said compartment to actuate the timer system thereby indicating the time a medication unit is again required to be taken, wherein said timer actuation means comprises:

(j) a floor within said compartment of said housing having a plurality of spaced seats; and (k) a plurality of contacts in said circuit mounted under each of said seats, said contacts electrically connected between said seats to close one of said contacts so that said timer will operate till said next adjustable timer interval.

2. A device as in claim 1, wherein said buttons include means for locking each button at a predetermined setting.

* * * * *